United States Patent [19]

Ohlbach

[11] 4,211,324

[45] Jul. 8, 1980

[54] ASSEMBLY PROTECTING AND INVENTORYING PRINTED CIRCUIT BOARDS

[76] Inventor: Ralph C. Ohlbach, 417 Green Park Ct., Deerfield, Ill. 60015

[21] Appl. No.: 931,866

[22] Filed: Aug. 7, 1978

[51] Int. Cl.[2] ..... B65D 85/00; B65D 85/42

[52] U.S. Cl. ..... 206/328; 206/444; 206/518; 229/DIG. 11; 53/471; 361/212

[58] Field of Search ..... 29/626; 229/DIG. 11; 260/42.49; 206/331, 444, 518; 53/471; 252/511; 361/212

[56] References Cited

U.S. PATENT DOCUMENTS

| | | | |
|---|---|---|---|
| 1,504,292 | 8/1924 | Wickes . | |
| 2,979,250 | 4/1961 | Hobbs | 229/DIG. 11 |
| 3,774,757 | 11/1973 | Harris et al. . | |
| 4,037,267 | 7/1977 | Kisor | 206/331 |
| 4,038,693 | 7/1977 | Huffine . | |

FOREIGN PATENT DOCUMENTS

| | | | |
|---|---|---|---|
| 775042 | 1/1968 | Canada | 252/511 |
| 2753258 | 6/1978 | Fed. Rep. of Germany | 252/511 |
| 1321584 | 2/1963 | France | 229/DIG. 11 |
| 6504232 | 11/1965 | Netherlands . | |

OTHER PUBLICATIONS

Insulation/Circuits Jan. 1977, pp. 25,26.

1969-1970 Plastics Encylopedia pp. 936-938.

*Primary Examiner*—Francis S. Husar

*Assistant Examiner*—C. J. Arbes

*Attorney, Agent, or Firm*—Kinzer, Plyer, Dorn & McEachran

[57] ABSTRACT

A stackable tray or container for assembly of or inventorying or transporting printed circuit board components, constructed of paper board coated on inside surfaces with conductive carbon black particles.

6 Claims, 3 Drawing Figures

Fig. 1.
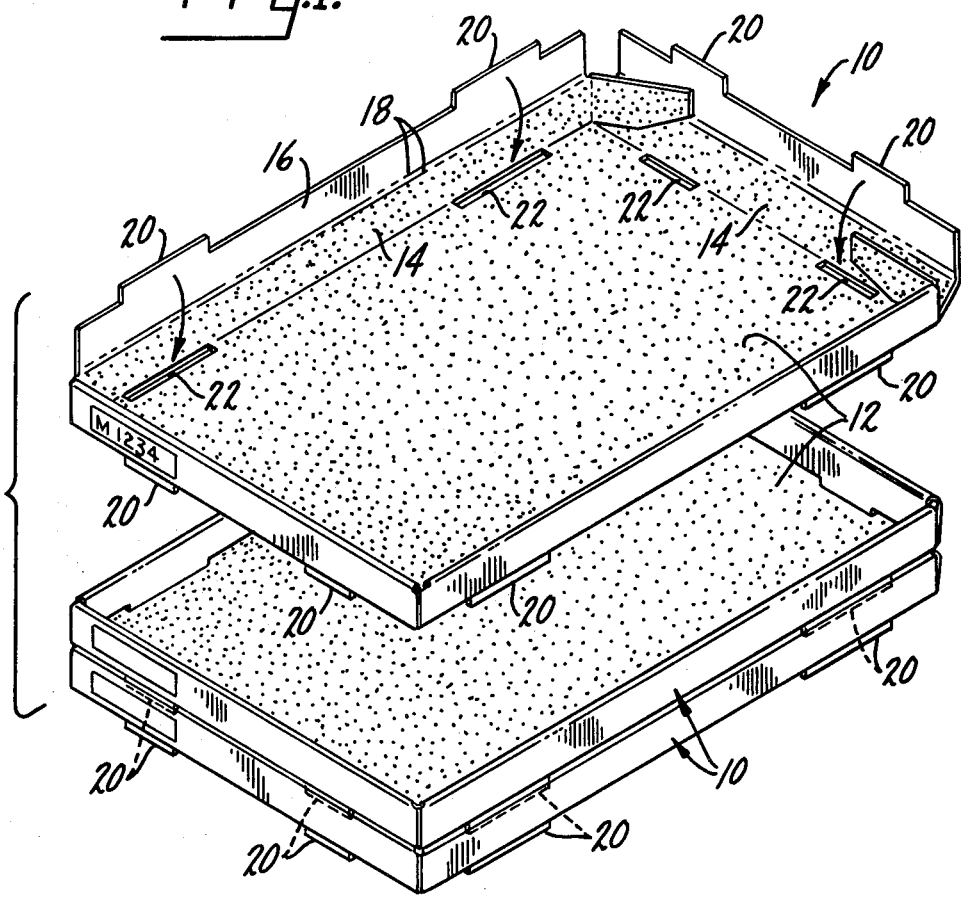
Fig. 2.
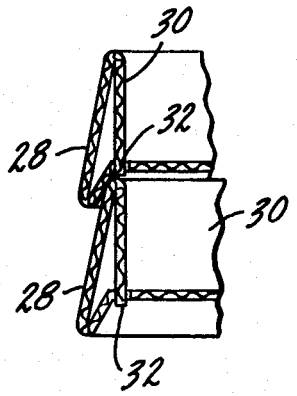
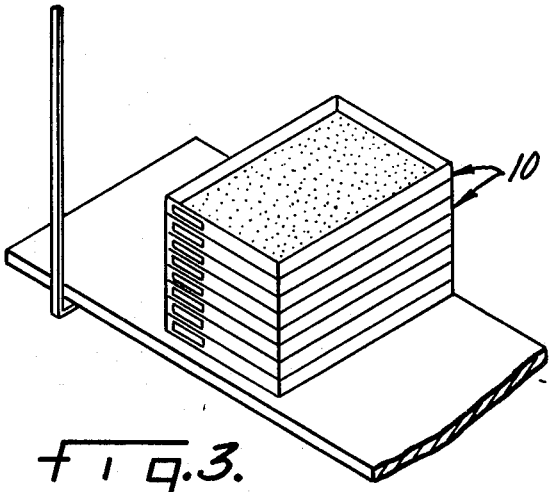
Fig. 3.

ASSEMBLY PROTECTING AND INVENTORYING PRINTED CIRCUIT BOARDS

This invention relates to the protection of printed circuit boards.

Static electricity has become a large problem for the electronics industry. With the advent of micro circuitry and the use of integrated circuits incorporating metal oxide semiconductors, complementary metal oxide semiconductors and field effect transistor silicon chips, packaging for shipping, storing and transferring printed circuit (PC) boards within production and service lines must offer protection against static electricity. Static electricity is originated in different ways but most commonly by movement of the person about the floor so that a charge is transferred from the person's hand to the circuitry, resulting in critical damage to one or more of the chips, which most of the time is not even known.

To date there is only a carbon impregnated plastic bag to protect the printed circuit boards from being damaged by large charges of static electricity. There is semi-clear polyethylene (bag or wrapping material) and also a "pink bubble" wrap material but each of these materials has proven to be only surface resistant up to twenty-five hundred volts per square inch, whereas the static charge can be much higher.

The use of flimsy plastic bags containing conductive carbon has proven to be costly and inadequate for handling, storing, inventory control and shipping of PC boards. Also the printed circuit board, during assembly at the manufacturing plant, has to be removed from the bag, some chips added at one station, reinserted in the bag, the bag slid to the next work station where more chips are added, and so on. A similar procedure is involved when the repairman services customer equipment. His service kit may contain a collection of printed circuit boards totalling a worth of thousands of dollars. He locates the defective PC board, removes a new PC board (bagged) from the kit, replaces the defective PC board, inserts the defective board in the bag, returns to his service point, packages the defective board in a shipping-carton and returns it to the manufacturer. The shipping carton is usually thrown away and this is also true of the carton used to return the replacement board to the manufacturer. During this procedure, as in the assembly process, a static charge may be inadvertently transferred to the board resulting in further damage to the circuitry and hence no one really knows the source of the defect in the first place. The repairman blames the manufacturer, the manufacturer blames the repairman and the customer doesn't know who to blame.

An inability to determine the source of the fault also occurs on the assembly line where the conductive carbon-impregnated plastic bags are also used to guard the PC board against static charges. Thus, repeated removal of the printed circuit board from the bag and reinsertion is necessarily accompanied by as many chances for transfer of a static charge to the circuitry.

The magnitude of the problem is immense. One local manufacturer assembles and releases over twenty thousand printed circuit boards per week and those boards, for the most part, are shipped out to the repairman for replacement purposes in the field or for shipment to further assembly plants. Some may go into inventory at one place or another.

The impregnated plastic bag does safeguard the PC board against static charges of large voltage but it is expensive, it has a useful life of only about six handlings, there is no assurance against transferring a charge when the PC board is outside the bag during assembly of PC board components, the bag does not lend itself to inventory control and the bag does not safeguard the PC board against physical damage. Consequently the primary objects of the present invention are to reduce the amount of handling of a printed circuit board during assembly, to make possible easier assembly of printed circuit boards, to save cost and to make possible a unique mode of inventory control.

In accordance with the present invention printed circuit boards are assembled inside a tray of paper board coated on inside surfaces with a coating of conductive carbon black, preferably applied as a dispersion of conductive carbon black particles in a printing ink varnish. Thus, the essential requirement is conductive carbon black adherent to inside paper surfaces of the tray so that a static charge from the outside will not reach the PC board. Thus, if there is a static charge on the hand of the assembler touching the outside of the tray, the charge, though it may be large enough to traverse the thickness of the tray from the outside, is trapped by the conductive coating and simply travels around the coating on an inside paper surface of the tray until it is dissipated or bled off to the atmosphere. The coating is capable of trapping a static charge in excess of fifty thousand volts per square inch.

The board of paper may be one of two grades for the minimum strength required in most instances: it may be corrugated E-flute board or of the grade known as folding carton board which has no corrugation. Both E-flute corrugated board and folding carton board are terms of strength in the paper industry.

In the drawing:

FIG. 1 is a perspective view of trays conforming to the present invention, ready to be stacked;

FIG. 2 is a view showing another form of tray;

FIG. 3 is a perspective view showing inventorying of the trays.

The tray must be stackable, that is, so constructed that one may be nested part way inside or supported atop the one below without touching the printed circuit in the one below. The stack may be of indefinite height but the top-most tray will serve as a top cover and hence will not contain a printed circuit board. Two forms of tray will be described; many other equivalent forms stackabable containers may be used.

By employing a tray, one wall may bear a label identifying the contained printed circuit board. This aids inventory as will be explained.

Referring to the drawing, the trays 10, FIG. 1, are identical, each including a bottom wall 12 and four enclosing side walls 14. The trays 10 are of folding carton board grade. They are one-piece, die cut. The side walls may include fold-over flaps 16, foldable along fold lines 18 inward toward the bottom of the tray, each flap having a pair of tongues 20 insertable into and projectable outward of corresponding openings 22 in the bottom wall so that the projecting tongues at the bottom wall of the top tray fit nestably inside the open end of the bottom tray, keeping the top tray anchored against displacement laterally, while the bottom wall of the top tray reposes on the upper edges of the bottom tray side walls free of the PC board beneath.

Each tray, except the top-most one, will contain a printed circuit board to be worked on at different stations during assembly. In comparison to the present practice of bagging each printed circuit board, taking it out of the bag, re-inserting it and then moving the bag to the next station, the person on the assembly line removes the cover tray (top-most tray) works on the printed circuit board beneath while it remains in the tray, lifts and sets that tray aside to expose the printed circuit board in the one beneath, works on that one, then stacks its tray atop the one set aside and so on. The stack of trays containing the completed work is then moved to the next station. The printed circuit board need not be removed from the tray unless absolutely necessary as an incident to some unusual chip or circuit job. Thus, there need be no removal and re-insertion as in the instance of the conductive plastic bag, although it may sometimes be necessary to lift the PC board from the tray as when soldering is required.

The paper surfaces constituting the inside of each tray are coated with a coating of conductive carbon black denoted by stippling. The coating may be applied at the plant where the tray board is die cut and scored. The coating is applied as a printing process. It will be noted in this regard that only the inside surfaces of the side walls 14 need to be coated and not necessarily any surface of the fold-over flap 16 attached thereto since any static charge will be stopped by the coating on wall 14, which is enough. In effect the conductive coating is applied to inside paper surfaces opposite an outside paper surface.

The coating vehicle (carrier) may be composed of seventy pounds of water and thirty pounds of any preferred printing ink varnish containing twelve and one half pounds of dispersed conductive carbon black particles. This calculates out to one and one-quarter pounds of conductive carbon black per gallon. The coating may be roller coated or applied in any other convenient manner. A coating weight corresponding to one hundred square feet per pound (above formula) is capable of sustaining a charge of about fifty thousand volts per square inch.

Another tray construction is shown in FIG. 2. The side walls are provided with outside flaps 28 constituting a skirt extending slightly below (and entirely around) the free top edges of the tray beneath, just enough to allow the skirt of the top tray to slightly mask the top of the tray beneath which itself supports the top tray. The inside wall 30 may have tongues 32 on the lower edge fitting slots in the bottom wall as described above. These trays may also be one-piece, die cut. The mask provided by the skirt helps guard the contents physically.

In any event, a side wall of each tray, on the outer face, may bear an identification mark or label (e.g. M 1234 as shown) of the contained printed circuit board.

At the termination of the assembly procedure, after all the chips have been emplaced at the various assembly stations, the entire stack of trays or any portion thereof may be shelved for inventory at the assembly plant with the end wall identification marks facing outward as shown in FIG. 3, or a group of the stacked trays may be inserted into a shipping container with the marked ends visible as an aid to inventory at the receiving point.

The printing ink varnish is preferred as the principal vehicle for the carbon black particles because it represents an inexpensive, paper adherent, easily dried tacky (adhesive) material for effectively holding in dispersed form the carbon black particles and itself being adherent to the paper to anchor the carbon black particles. Any equivalent tacky vehicle may be used, that is, the varnish may be replaced by an acrylic or any other liquid vehicle employed in paper board printing inks capable of disposing carbon black conductive particles. Also, as noted, corrugated board (double faced) may be used and in some instances may be preferred.

If desired, each tray, following completion of the printed circuit, may be protectively wrapped around all edges and surfaces in plain or polyethylene "pink bubble", or a tray may be slid into an open ended, individual container box of the kind disclosed in my companion application Ser. No. 931,867, filed Aug. 7, 1978, now U.S. Pat. No. 4,160,503. Other anti-static wrappers may be used rather than polyethylene "pink bubble".

Two forms of achieving an interlocked nesting of the stacked trays have been shown but there are many other ways. The essential requirement is a tongue, skirt, stop lug or other protruding or interferring means on the tray permissive of nesting like trays while limiting lateral displacement in either direction and while spacing the bottom wall of the top tray from the PC board in the tray beneath.

The coating, composed of water and the ink vehicle, is an emulsion of course and the conductive particle preference is VULCAN XC-72LR conductive carbon black particles supplied by Cabot Corporation: 98.5% by weight fixed carbon (1.5% volatiles), 19 millimicrons mean diameter, log volume resistivity (ohms-cm) in the range of about 2.3 to 6.

I claim:

1. A stack of containers each encompassing at least one printed circuit board contained therein, one container being supported atop an identical container constructed entirely of one-piece paper board, either folding carton board or corrugated board at least of E-flute strength for minimum strength, said container beneath and each container having an open top, a bottom wall and enclosing side walls attached to the bottom wall, all inside surfaces of each container opposite outside surfaces thereof being coated with conductive carbon black particles contained in a printing ink vehicle for capturing a static electricity charge originating outside the container.

2. A stack of containers according to claim 1 wherein each container has an inventory marking on the outside of one of the side walls thereof.

3. A method of inventorying printed circuit boards susceptible to being ruined by a discharge of static electricity and comprising: placing individual printed circuit boards each in a container having an open top, a bottom wall and enclosing side walls attached to the bottom wall, each container being constructed of paper board with all inside surfaces thereof opposite outside surfaces being coated with conductive carbon black particles contained in a printing ink vehicle for capturing a static electricity charge originating outside the container, stacking one container containing a printed circuit board atop another which contains a printed circuit board, and topping off the stack with a cover.

4. A method according to claim 3 including the step of applying an inventory marking on the outside of one of the side walls of each container and in which said walls of each container are constructed entirely of one-piece paper board, either folding carton board or corrugated board at least of E-flute strength for minimum strength.

5. A method according to claim 4 in which the cover is paper board coated with conductive carbon black particles.

6. A stack of containers according to claim 1 or 2 in which each container includes protruding means permissive of nesting while limiting lateral displacement when one container is stacked atop a like container beneath.

* * * * *